US005447113A

United States Patent [19]

Chernin

[11] Patent Number: 5,447,113

[45] Date of Patent: Sep. 5, 1995

[54] RUDDER

[76] Inventor: Leonid Chernin, 22 Hachalutz St., Herzlia 46795, Israel

[21] Appl. No.: 360,225

[22] Filed: Dec. 20, 1994

Related U.S. Application Data

[63] Continuation of Ser. No. 193,719, Feb. 9, 1994, abandoned.

[30] Foreign Application Priority Data

Feb. 10, 1993 [IL] Israel ..... 104675

[51] Int. Cl.[6] ..... B63H 25/06

[52] U.S. Cl. ..... 114/162; 114/165

[58] Field of Search ..... 114/162, 163, 164, 165, 114/168, 109, 172

[56] References Cited

U.S. PATENT DOCUMENTS

| | | | |
|---|---|---|---|
| 3,575,124 | 4/1971 | Alter | 114/165 |
| 3,731,645 | 5/1973 | Pearce | 114/162 |
| 3,752,105 | 8/1973 | Hackett | 114/162 |
| 4,231,309 | 11/1980 | Pelletier | 114/162 |
| 4,319,538 | 3/1982 | Macfarlane | 114/162 |
| 4,711,192 | 12/1987 | Kooy | 114/162 |

FOREIGN PATENT DOCUMENTS

| | | | |
|---|---|---|---|
| 2372078 | 7/1978 | France | 114/162 |
| 2398662 | 3/1979 | France | 114/162 |
| 1544345 | 4/1979 | United Kingdom | 114/162 |

*Primary Examiner*—Stephen Avila
*Attorney, Agent, or Firm*—Steinberg, Raskin & Davidson

[57] ABSTRACT

A rudder assembly for a boat in which a rapid pivotal displacement of the tiller from a first position to a second position displaces the rudder into either a raised or a lowered position, and which comprises a biased locking means for releasably retaining said tiller in a first position.

8 Claims, 6 Drawing Sheets

Fig. 3
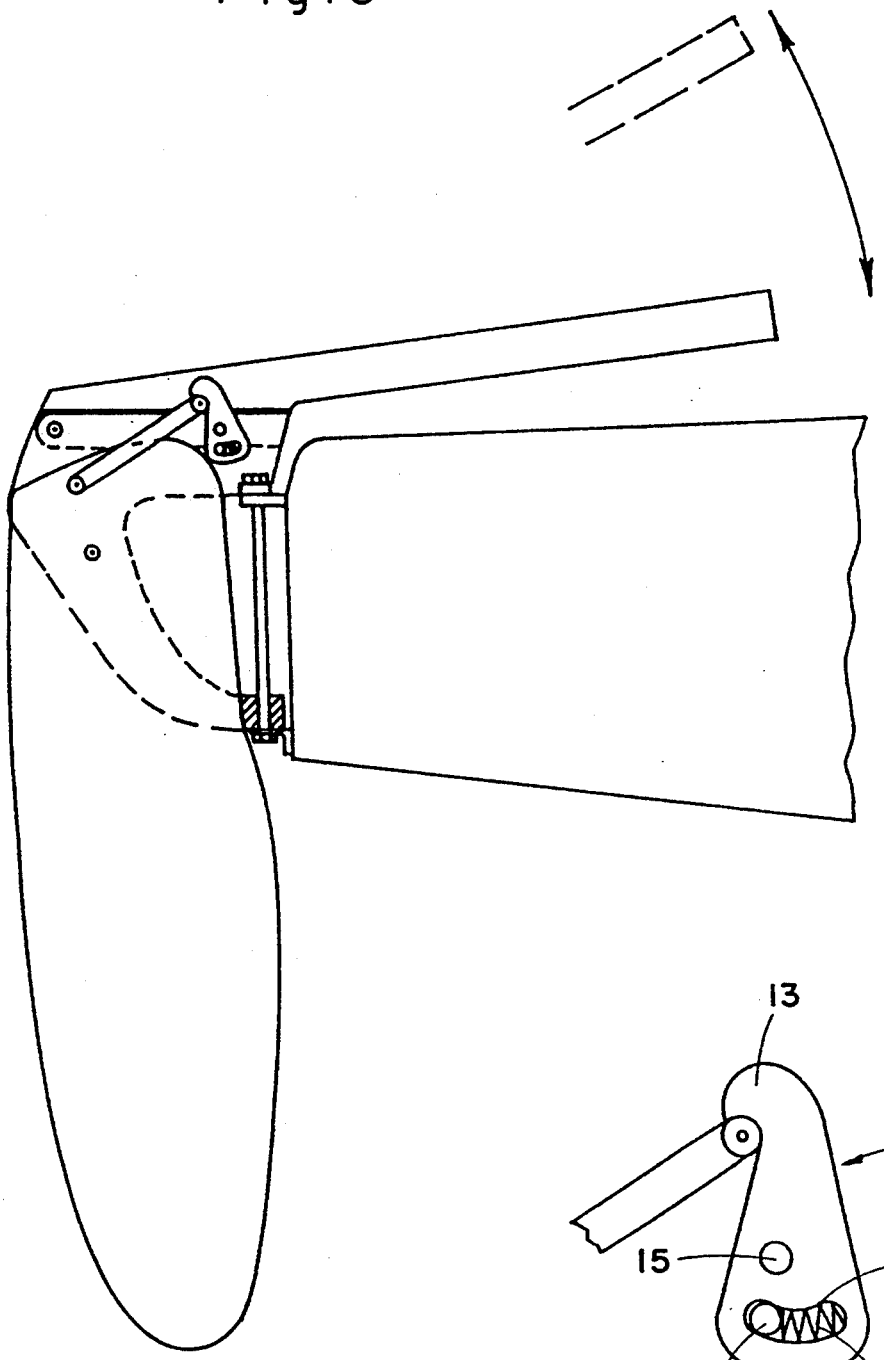
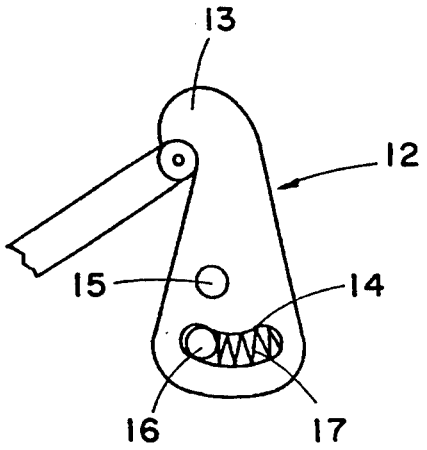
Fig. 5

RUDDER

This is a continuation of U.S. patent application Ser. No. 08/193,719, filed Feb. 9, 1994 now abandoned.

FIELD OF THE INVENTION

The present invention relates to a rudder assembly for a boat, in particular light sailing or motor boats, and in particular to such an assembly provided with means for raising and lowering the rudder out of and into a steering position.

BACKGROUND OF THE INVENTION

Rudder assemblies for boats must clearly be provided with means whereby the rudder can be readily raised or lowered out of or into its steering position. Thus, when the boat is being pushed into the water the rudder must clearly be raised, and in the water the rudder should be readily lowered into a steering position. Similarly, when approaching the shore it must be possible readily to raise the rudder and this possibility must also be readily available when the boat is in the vicinity of reefs or other objects which project from or are close to the water line.

Various proposals have been made and many have been put into practice for displacing the rudder into and out of its steering position, but these are all characterized by being relatively time consuming in operation with the consequent danger that, in an emergency such as, for example, when the boat is approaching a reef or other obstacle, it is not possible to quickly raise the rudder out of its exposed lowered position and, in consequence, the rudder and even the boat may be damaged. These problems arise even more acutely with catamarans, wherein each hull is provided with a separate rudder assembly and speed of operation in raising and lowering the rudder is even more essential.

It is an object of the present invention to provide a new and improved rudder assembly for a boat, wherein the above-referred-to disadvantages are significantly reduced.

BRIEF SUMMARY OF THE INVENTION

According to the present invention there is provided a rudder assembly for a boat comprising:

- a rudder support bracket for mounting on the boat so as to be pivotable about a rudder steering axis;
- a rudder coupled to said bracket so as to be pivotable with respect thereto about a first axis substantially normal to said steering axis and to a longitudinal axis of the boat;
- a tiller coupled at a first end thereof to said bracket so as to be pivotable with respect thereto about a second axis substantially parallel to said first axis; and
- a coupling rod coupled at a first end thereof to said tiller so as to be pivotable with respect thereto about a third axis adjacent and parallel to said second axis, and coupled at a second and opposite end thereof to said rudder so as to be pivotable with respect thereto about a fourth axis adjacent and parallel to said first axis;

the arrangement being such that a rapid pivotal displacement of the tiller from a first position to a second position displaces the coupling rod from a first condition wherein said first, third and fourth axes are non-aligned through a dead center condition wherein said axes are aligned and into either of two maximally displaced conditions wherein said axes are non-aligned and said rudder is displaced into either a raised or a lowered position.

Preferably, there is provided a spring biased locking means mounted on said bracket for releasably retaining said tiller in a first position.

With such a rudder assembly in accordance with the invention a simple, rapid displacement of the tiller from its locked (preferably lowered) position is effective in displacing the rudder either into its lowered steering position or its raised position. As indicated, the displacement of the tiller is accompanied by a corresponding displacement of the coupling rod through its dead center position and a corresponding pivotal displacement of the rudder. The initial momentum imparted to the rudder as a result of the initial rapid displacement of the tiller enables it to move under its own inertia into the required final raised or lowered position. It will be appreciated, in this connection, that when the rudder is to be lowered into its steering position, the effects of inertia in completing its displacement into the lowered steering position are supplemented by the weight of the rudder itself.

Preferably, the spring biased locking means is so designed that any untoward encounter of the lowered rudder with an object such as a rock, a large fish, or the like results in the release of the locking mechanism and thereby allows for the movement of the rudder under the force of impact, thereby minimizing damage to the rudder as a result of the impact.

BRIEF DESCRIPTION OF THE DRAWINGS

One embodiment of a rudder assembly in accordance with the present invention will now be described by way of example and with reference to the accompanying drawings, in which:

FIG. 3 is a side elevation of the rudder assembly shown in FIG. 2, with the tiller lowered into its locked position;

FIG. 5 is a view on an enlarged scale of the locking means shown in the preceding figures;

DETAILED DESCRIPTION OF PREFERRED EMBODIMENT

Figure 1:
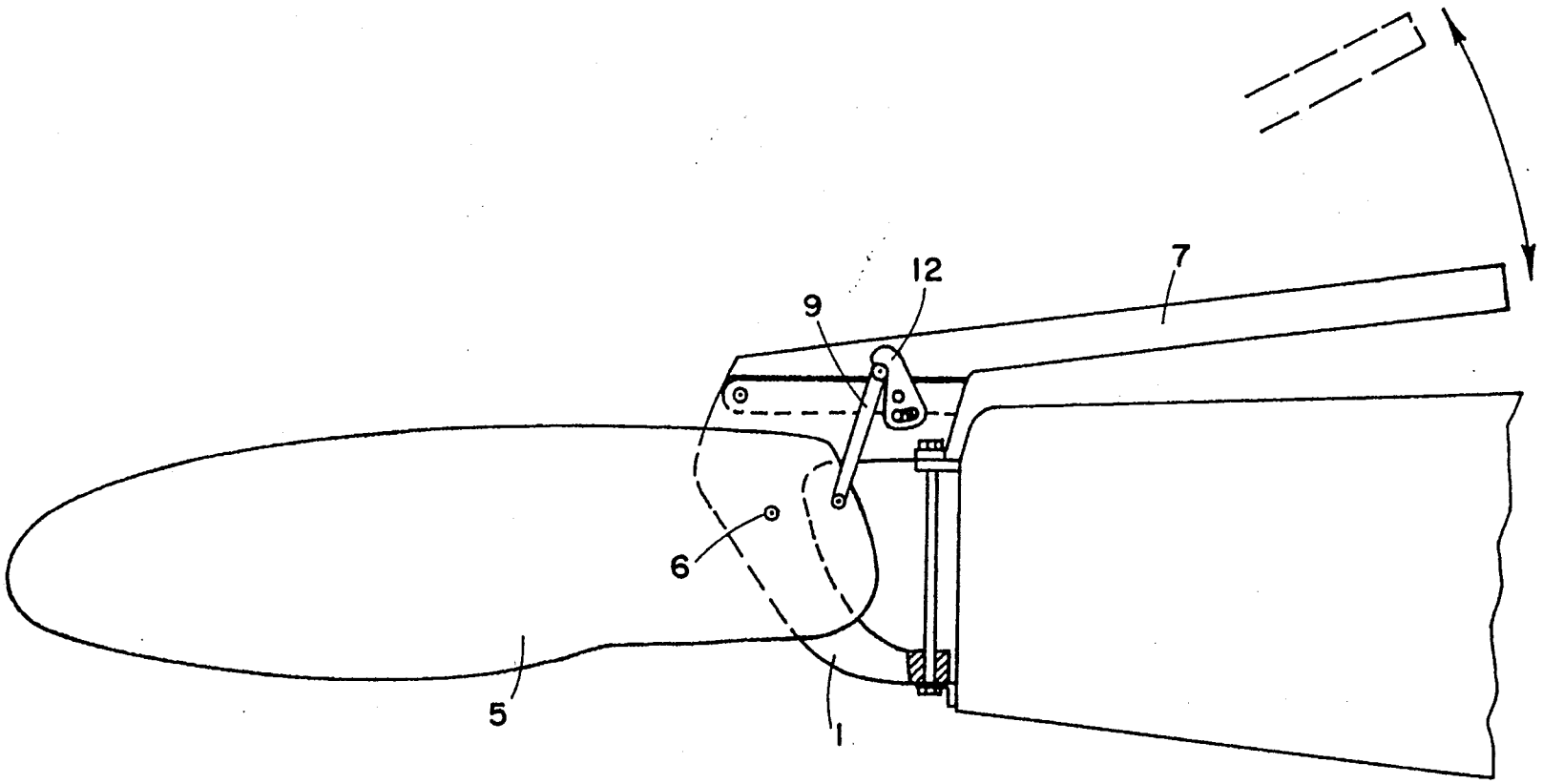
FIG. 1 is a side elevation of the rudder assembly shown attached to a portion of a boat hull with the rudder in a raised position.

As shown in the drawings, the rudder assembly comprises a C-shaped, double-walled mounting bracket 1 (for clarity of understanding, one of the walls is shown removed) which is pivotally mounted on a pivotal axle 2 journalled with respect to bearings 3*a* and 3*b* which are, in their turn, mounted on a hull 4 of a boat (not otherwise shown). The bracket 1 is therefore pivotable with respect to the hull 4 about an axis hereinafter referred to as the "rudder steering axis".

A rudder 5 has an innermost end thereof located between the walls of the bracket 1 and is pivotally mounted with respect thereto about an axle 6 (constituting a first pivotal axis) directed normally with respect to the rudder steering axis.

A tiller 7 is coupled at an end *7a* thereof to the bracket 1 about an axle 8 constituting a second pivotal axis substantially parallel to the first pivotal axis.

A coupling rod 9 is pivotally coupled at a first end thereof to the end *7a* of the tiller 7 about an axle 10 constituting a third pivotal axis located adjacent to and parallel to the second pivotal axis. The coupling rod 9 is pivotally coupled at an opposite end thereof to the rudder 5 about an axle 11 constituting a fourth pivotal axis located adjacent and parallel to the first pivotal axis.

A locking bar 12 (seen clearly in FIG. 5 of the drawings) constituting locking means is formed at an upper end thereof with a locking hook 13 and, at a lower end thereof, with a crescent-shaped slot 14. The locking bar 12 is pivotally mounted with respect to the bracket 1 about a pivotal axis 15. An abutment pin 16 integral with the bracket 1 projects into the slot 14 in which is also located a biasing spring 17 tending to bias the locking bar 12 in an anti-clockwise direction with respect to the axle 15.

The operation of the assembly in lowering and raising the rudder will now be described.

As seen in FIG. 1 of the drawings, the rudder 5 is in a raised condition with the tiller 7 locked by means of the locking bar 12 (the locking nose 13 engages the uppermost end of the coupling bar 9) in a lowered position.

Figure 2:
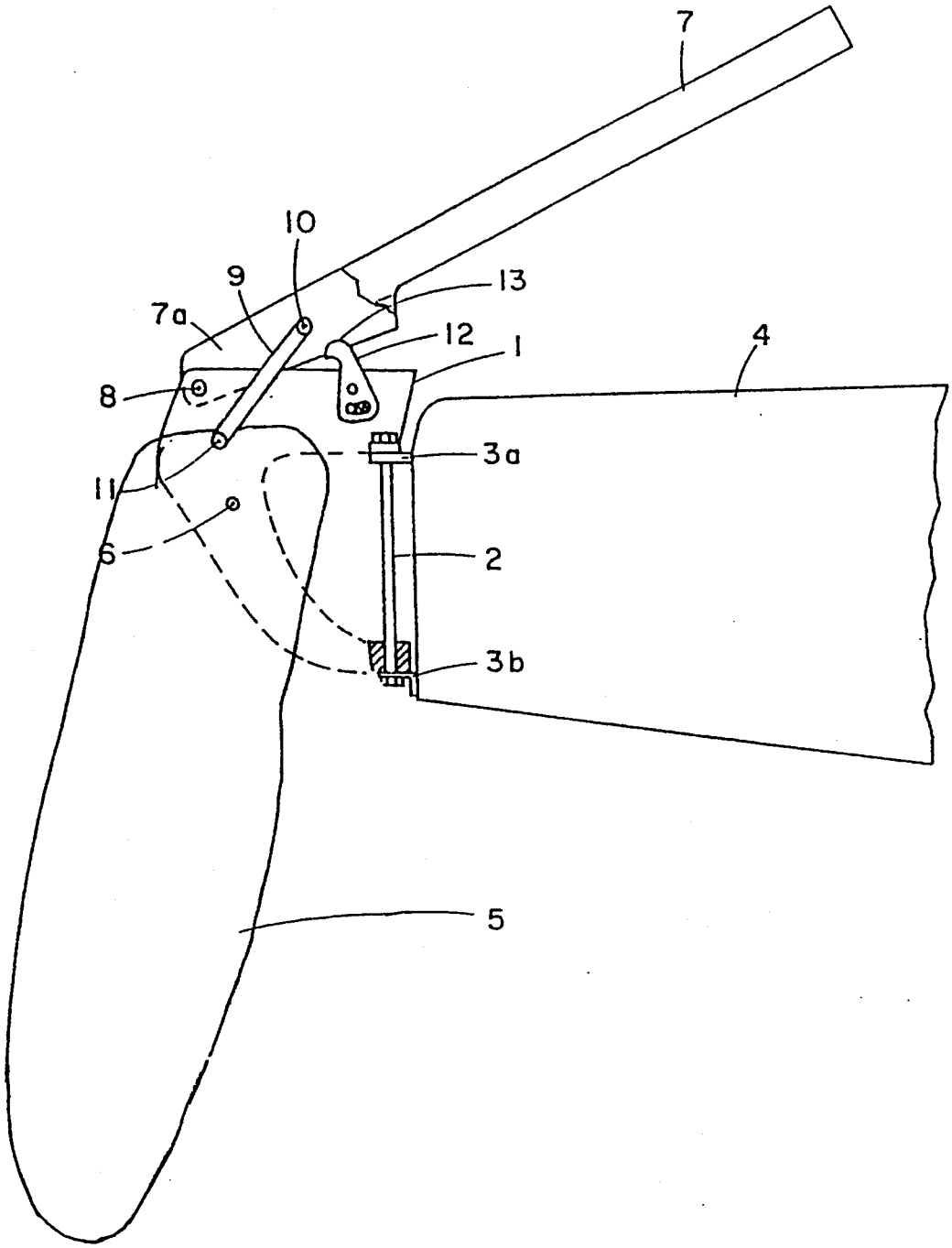
FIG. 2 is a side elevation of the rudder assembly shown in FIG. 1, with the rudder in a position prior to being locked in its steering position and with the tiller raised in an unlocked position.

If now it is desired to lower the rudder 5 into the steering position (as shown in FIG. 3 of the drawings) the free end of the tiller 7 is rapidly raised to the position shown in FIG. 2, causing the clockwise displacement of the locking bar 12 against the spring biassing and thereby releasing the tiller 7 from its locked position and, at the same time, resulting in the displacement of the coupling rod 9 and the consequent pivotal downward displacement of the rudder 5 about its pivotal axle 6. The rapid raising of the tiller 7 imparts to the rudder 5 sufficient momentum in its downward pivotal displacement so that, when the axles 6, 10 and 11 pass through their dead center aligned position, the rudder 5 will nevertheless continue under its own inertia in its downward displacement into its lowered position, whereupon the tiller 7 can then be lowered into the position shown in FIG. 3 and locked in this position by engagement with the locking bar 12.

The pivotal movement of the rudder 5 into its lowered position is also assisted by virtue of the weight of the rudder 5 itself.

When it is desired to raise the rudder 5 the tiller 7 is again rapidly raised, thereby releasing it from its locking engagement with the locking bar 12 and, as a result of the consequent displacement of the coupling rod 9, the rudder 5 is pivotally displaced about its axle 6 in a clockwise direction. The pivotal momentum induced in the rudder 5 as a result of this rapid displacement of the tiller 7 is such as to enable it to continue under its own inertia into a fully raised position, despite the fact that the coupling rod 9 passes through a dead center position wherein the axles 6, 11 and 10 are substantially aligned. In this case, too, once the rudder 5 will have reached its fully raised position as seen in FIG. 1 of the drawings, the tiller 7, which will then be in the raised position shown in broken lines in FIG. 1, can be returned to its full line position shown in FIG. 1, whereupon it is engaged and releasably retained by the locking bar 12. As has been clearly stressed, the effectiveness of the assembly in ensuring the rapid raising or lowering of the rudder 5 is dependent on the initial rapid raising of the tiller 7, thereby ensuring that the pivotal momentum imparted to the rudder 5 is sufficient for the rudder 5 to continue its displacement into the required position, despite the fact that the coupling rod 9 will have passed through its dead center position.

Figure 4:
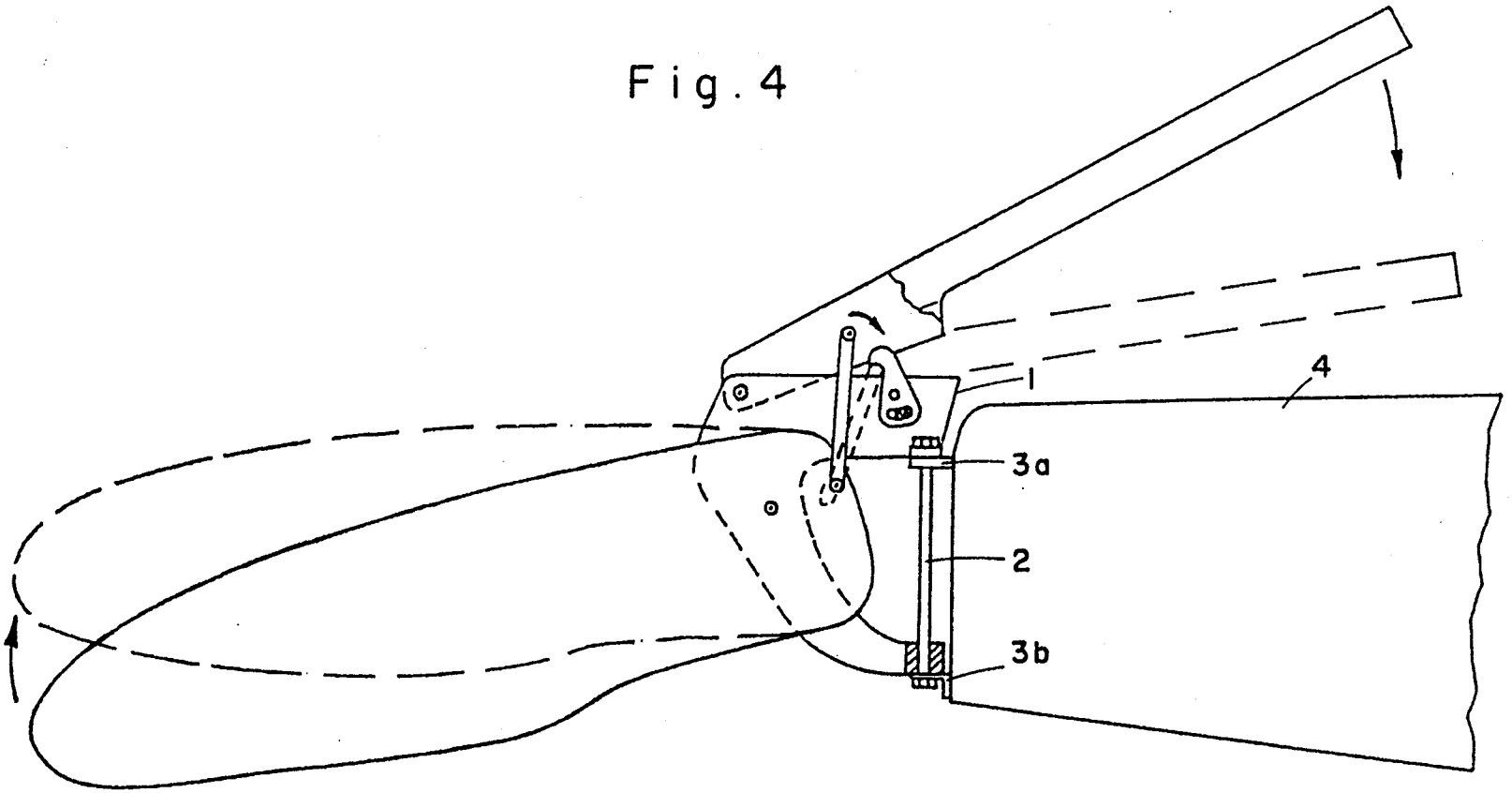
FIG. 4 is a side elevation of the rudder assembly shown in the preceding figures, illustrating the displacement of the rudder prior to being locked into its raised position.

Thus, as seen in FIG. 4 of the drawings, where the rudder 5 is initially in its raised position as shown in broken lines, the coupling rod 9 is in the position also shown in broken lines. If now the tiller 7 is raised slowly, the rudder 5 will be displaced into the position shown in full lines, as will be coupling rod 9. In this case, however, the momentum imparted to the rudder 5 will be insufficient to ensure that the rudder 5 continues its movement into the fully lowered position after the axes are fully aligned and the coupling rod 9 is in the dead center position, and the rudder 5 will remain in the full line position shown in FIG. 4. Upon return of the tiller 7 to its lowered position in which it becomes locked by the locking bar 12, the rudder 5 will return to its broken line position. A similar situation occurs when the rudder 5 is initially in its lowered position and the slow raising of the tiller 7 is insufficient to impart to the rudder 5 sufficient momentum to ensure its effective lowering into the steering position.

With the rudder 5 in the lowered steering position, any accidental encounter of the rudder 5 with an obstacle such as, for example, a rock or a large fish will result in the releasing displacement of the locking bar 12 and the consequent freeing for pivotal displacement of the rudder 5, thereby minimizing damage to the rudder by such an encounter. It will be appreciated that the spring biasing effected by the spring 17 is suitably chosen so as to ensure that, on the one hand, the tiller 7 is effectively locked against accidental release but, on the other hand, when necessary the tiller 7 can be rapidly released from locking, as well as upon accidental encounter of the rudder 5 with an obstacle.

Figure 6:
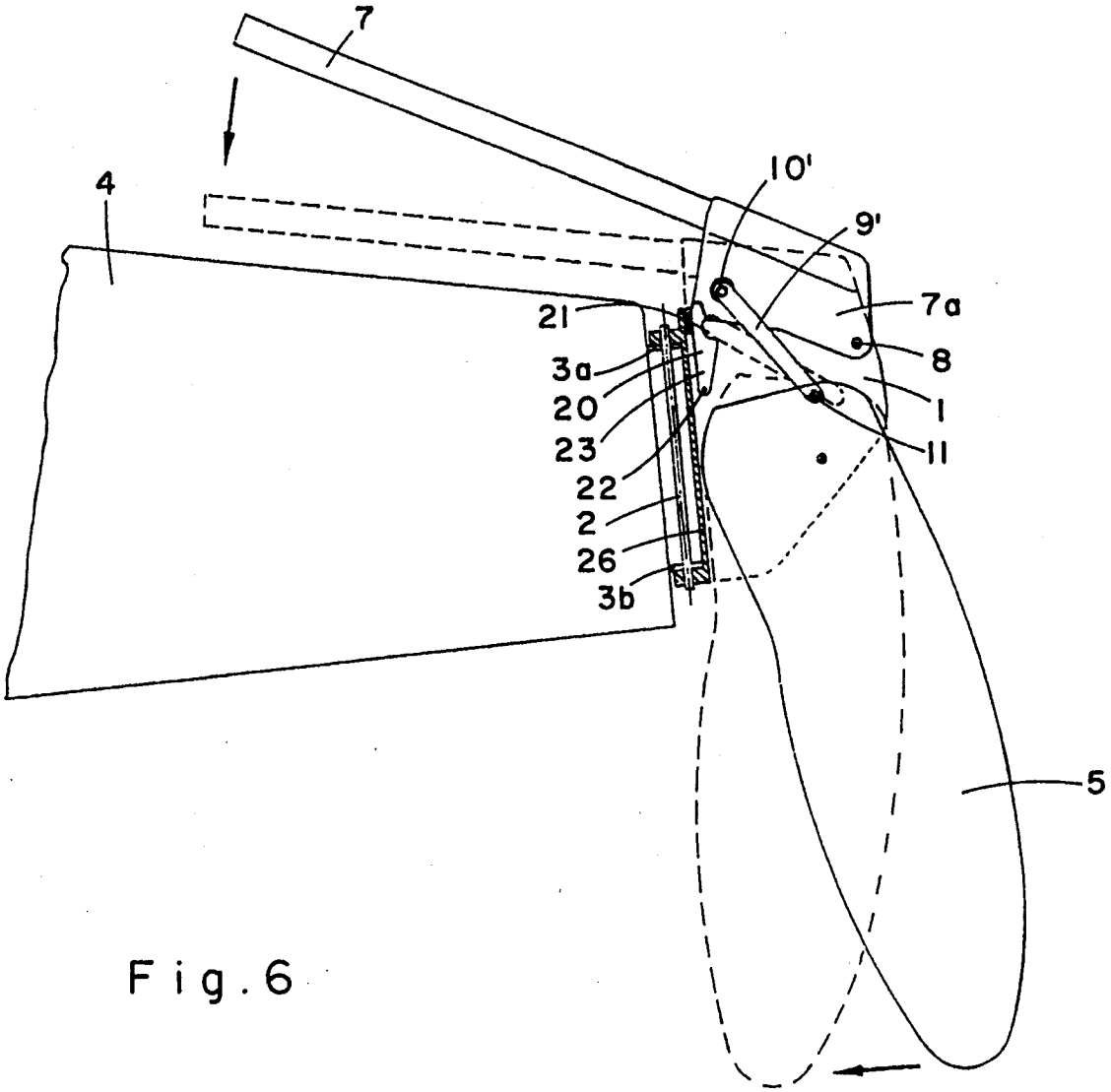
FIG. 6 is a side elevation of the rudder assembly illustrating the displacement of the rudder prior to being locked in its lowered position by means of a modified form of locking means.
Figure 7:
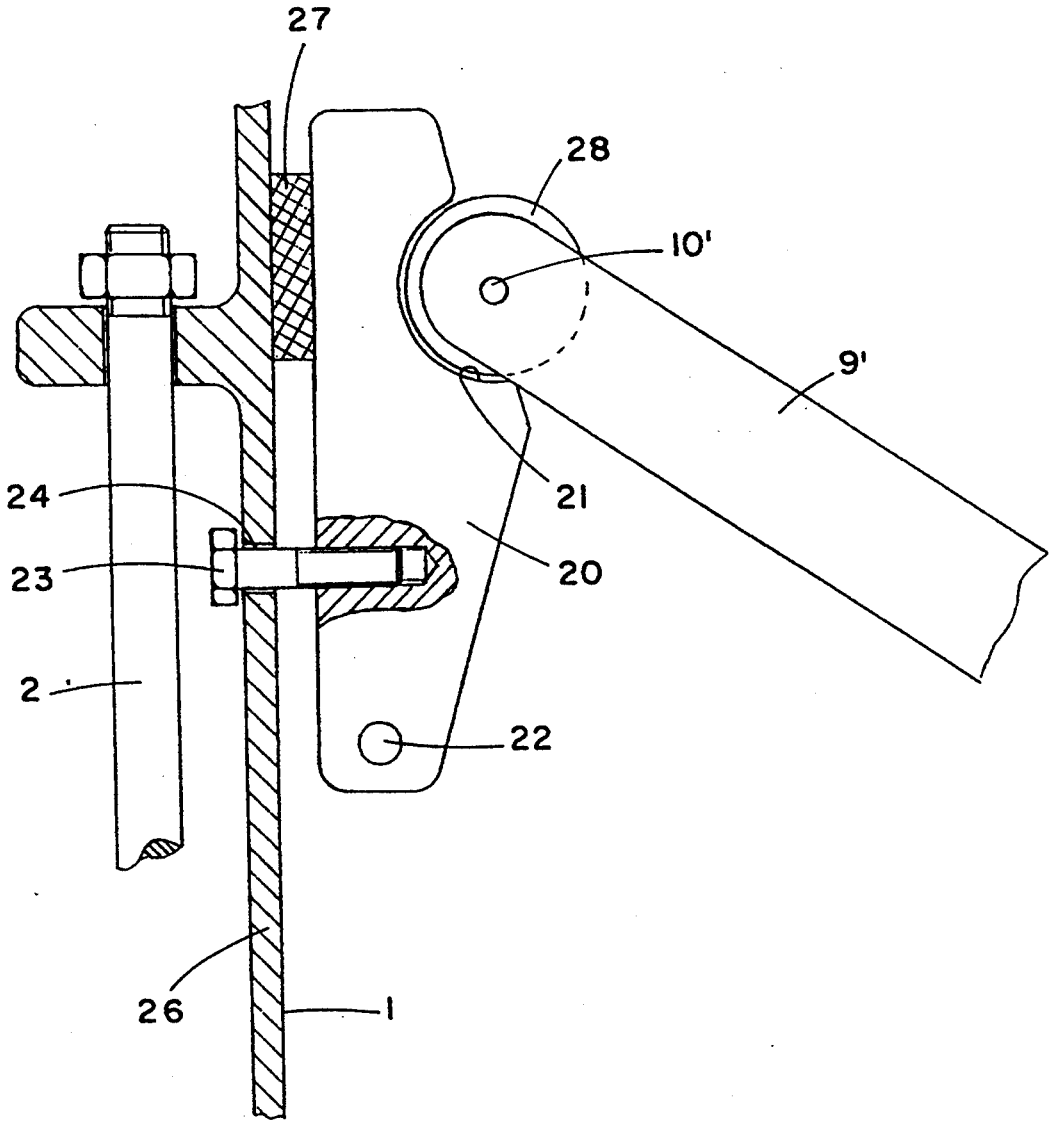
FIG. 7 is a view on an enlarged scale of the locking means shown in FIG. 6.

Reference is now made to FIGS. 6 and 7 of the drawings wherein a modified form of locking means is seen, in which those components which are similar to those of the previous embodiment are designated with similar reference numerals.

A locking member 20 has formed at an upper end thereof a locking recess 21 and is pivotally mounted on bracket 1 about a pivotal axis 22. An adjustment screw 23 is screwed to the locking member 20 via a hole 24 in a wall 26 of the bracket 1, the hole 24 having a larger diameter than that of the adjustment screw 23 and a resilient abutting member 27 is attached to locking member 25, biassing it in an anti-clockwise direction with respect to the axis 22. The first end of the coupling rod 9' has attached thereto a roller 28 free to rotate about the axis 10', the purpose of which is to assist in the engaging of said first end with the locking recess 21.

The engaging and disengaging of the coupling rod 9 with the locking member 20 is performed in a manner similar to that already explained in connection with the previous embodiment, the main difference being that according to the present modification, the force required for locking and unlocking is adjustable and may be pre-set according to the weight of the rudder and according to individual requirements simply by varying the position of the adjustment screw 23, thus varying the maximum degree of the angular displacement of the locking member.

With a rudder assembly in accordance with the present invention, the lowering and raising of the rudder 5 can be simply and effectively effected by a simple, instantaneous raising of the tiller 7. This is in contradistinction to the time-consuming methods employed with known rudder assemblies. Furthermore, the fact that one and the same tiller 7 can be employed both for steering and for raising and lowering the rudder 5 is, of course, a distinct advantage.

I claim:

1. A rudder assembly for a boat comprising:

a rudder support bracket for mounting on the boat so as to be pivotable about a rudder steering axis;

a rudder coupled to said bracket so as to be pivotable with respect thereto about a first axis substantially normal to said steering axis and to a longitudinal axis of the boat;

a tiller coupled at a first end thereof to said bracket so as to be pivotable with respect thereto about a second axis substantially parallel to said first axis; and a coupling rod coupled at a first end thereof to said tiller so as to be pivotable with respect thereto about a third axis adjacent and parallel to said second axis, and coupled at a second and opposite end thereof to said rudder so as to be pivotable with respect thereto about a fourth axis adjacent and parallel to said first axis;

the arrangement being such that a rapid pivotal displacement of the tiller from a first position to a second position displaces the coupling rod from a first condition wherein said first, third and fourth axes are non-aligned through a dead center condition wherein said axes are aligned and into either of two maximally displaced conditions wherein said axes are non-aligned and said rudder is displaced into either a raised or a lowered position.

2. A rudder assembly according to claim 1, further comprising a spring biased locking means mounted on said bracket for releasably retaining said tiller in a first position.

3. A rudder assembly according to claim 2, wherein said locking means comprises a locking bar formed at one end with a locking hook and at an opposite end with a crescent-shaped recess, said locking bar being pivotally mounted at an intermediate position thereof on said bracket, there being furthermore provided a projecting abutment integral with said bracket and projecting through said recess, and spring biasing means located within said crescent-shaped recess for biasing said abutment in an anti-clockwise direction.

4. A rudder assembly according to claim 2, wherein said locking means comprises a locking member formed at a top end with a locking recess and being pivotally mounted on said bracket, there being provided a resilient abutting member for biassing said locking member in a clockwise direction, there being furthermore provided an adjustment screw for limiting the angular displacement of the locking member.

5. A rudder assembly for a boat comprising:

a rudder support bracket for mounting on the boat so as to be pivotable about a rudder steering axis;

a rudder coupled to said bracket so as to be pivotable with respect thereto about a first axis substantially normal to said steering axis and to a longitudinal axis of the boat;

a tiller coupled at a first end thereof to said bracket so as to be pivotable with respect thereto about a second axis substantially parallel to said first axis;

a coupling rod directly pivotally connected at a first end thereof to said tiller so as to be pivotable with respect thereto about a third axis adjacent and parallel to said second axis, and directly pivotally connected at a second and opposite end thereof to said rudder so as to be pivotable with respect thereto about a fourth axis adjacent and parallel to said first axis;

said rudder, said tiller, said coupling rod and said bracket comprising an arrangement wherein said tiller is movable between a first position and a second position and constitutes means for displacing said coupling rod upon rapid pivotal displacement as said tiller moves from said first position to said second position from a first condition wherein said first, third and fourth axes are non-aligned through a dead center condition wherein said first, third and fourth axes are aligned and then into either of two maximally displaced conditions wherein said first, third and fourth axes are non-aligned such that said rudder is displaced into either a raised or a lowered position.

6. A rudder assembly according to claim 1, wherein said tiller is elongate and has a longitudinal axis substantially perpendicular to said second and third axes, and the movement of said tiller from said first position to said second position does not entail any movement of said tiller along said longitudinal axis.

7. A rudder assembly according to claim 1, wherein said coupling rod is directly connected at said first end to said tiller and directly connected at said second end to said rudder.

8. A rudder assembly according to claim 1, wherein said coupling rod is directly pivotally connected at said second end to said rudder.

* * * * *